US007741999B2

(12) United States Patent
Mierke et al.

(10) Patent No.: US 7,741,999 B2
(45) Date of Patent: Jun. 22, 2010

(54) MULTILAYER ANTENNA OF PLANAR CONSTRUCTION

(75) Inventors: Frank Mierke, Munich (DE); Gerald Schillmeier, Munich (DE)

(73) Assignee: Kathrein-Werke KG, Rosenheim (DE)

( * ) Notice: Subject to any disclaimer, the term of this patent is extended or adjusted under 35 U.S.C. 154(b) by 334 days.

(21) Appl. No.: 11/453,253

(22) Filed: Jun. 15, 2006

(65) Prior Publication Data

US 2008/0122697 A1 May 29, 2008

(51) Int. Cl.
*H01Q 1/38* (2006.01)

(52) U.S. Cl. ..... 343/700 MS

(58) Field of Classification Search ..... 343/700 MS
See application file for complete search history.

(56) References Cited

U.S. PATENT DOCUMENTS

| | | | | |
|---|---|---|---|---|
| 5,307,075 | A | 4/1994 | Huyah | |
| 5,315,753 | A * | 5/1994 | Jensen et al. | 29/600 |
| 5,745,079 | A | 4/1998 | Wang et al. | |
| 5,880,694 | A | 3/1999 | Wang et al. | |
| 6,359,589 | B1 * | 3/2002 | Bae | 343/700 MS |
| 7,218,280 | B2 * | 5/2007 | Annamaa et al. | 343/700 MS |
| 7,224,280 | B2 * | 5/2007 | Ferguson et al. | 340/572.7 |
| 2003/0011529 | A1 * | 1/2003 | Gottl | 343/795 |
| 2004/0061648 | A1 * | 4/2004 | Pros et al. | 343/700 MS |
| 2004/0150561 | A1 * | 8/2004 | Tillery et al. | 343/700 MS |
| 2004/0212536 | A1 * | 10/2004 | Mori et al. | 343/700 MS |
| 2006/0001574 | A1 * | 1/2006 | Petros | 343/702 |
| 2006/0202900 | A1 * | 9/2006 | Simile | 343/792.5 |
| 2006/0238432 | A1 * | 10/2006 | Mikami et al. | 343/795 |
| 2007/0216589 | A1 * | 9/2007 | Li et al. | 343/713 |

FOREIGN PATENT DOCUMENTS

| | | | |
|---|---|---|---|
| CA | 2082580 | | 4/2002 |
| DE | 69230365 | T2 | 3/2000 |
| EP | 1376758 | A1 | 1/2004 |
| JP | 2-150101 | | 8/1990 |
| JP | 7-94934 | | 7/1995 |
| KR | 1020040072974 | | 8/2004 |
| WO | 0180352 | A1 | 10/2001 |

OTHER PUBLICATIONS

Robert E. Munson: "Conformal Microstrip Antennas and Microstrip Phased Arrays," IEEE Transactions on Antennas and Propagation, pp. 74-78 (Jan. 1974).

S.A. Long, M.D.: Walton "A Dual-Frequency Stacked Circular-Disc Antenna," IEEE Transaction on Antennas and Propagation, vol. AP-27, No. 2, pp. 270-273 (Mar. 1979).

(Continued)

*Primary Examiner*—Douglas W Owens
*Assistant Examiner*—Dieu Hien T Duong
(74) *Attorney, Agent, or Firm*—Nixon & Vanderhye PC

(57) ABSTRACT

A multilayer antenna of planar construction comprises an electrically conductive ground face and a conductive radiation face which is arranged with lateral spacing from the ground face and extends substantially parallel thereto. A dielectric carrier is arranged between the ground face and the radiation face. Above the radiation face there is a carrying means. Above the carrying means there is provided an electrically conductive patch element. The carrying means has a thickness or height which is less than the thickness or height of the patch element.

23 Claims, 5 Drawing Sheets

OTHER PUBLICATIONS

Rod B. Waterhouse: "Design of Probe-Fed Stacked Patches," IEEE Transactions on Antennas and Propagation, vol. AP-47, No. 2, pp. 1780-1784 (Dec. 1999).

Rod B. Waterhouse: "Stacked Patches Using High and Low Dielectric Constant Material Combinations," IEEE Transactions on Antennas and Propagation, vol. AP-47, No. 12, pp. 1767-1771 (Dec. 1999).

* cited by examiner

MULTILAYER ANTENNA OF PLANAR CONSTRUCTION

CROSS-REFERENCES TO RELATED APPLICATIONS

Not applicable.

STATEMENT REGARDING FEDERALLY SPONSORED RESEARCH OR DEVELOPMENT

Not applicable.

TECHNOLOGY FIELD

The technology herein relates to a multilayer antenna of planar construction.

BACKGROUND AND SUMMARY

Patch antennas or what are known as microstrip antennas are sufficiently well known. They conventionally comprise an electrically conductive base, a dielectric carrier material arranged thereabove and an electrically conductive radiation face provided on the upper side of the dielectric carrier material. The upper radiation face is generally stimulated by a supply line extending transversely to the aforementioned planes and layers. The connection cable used is usually a coaxial cable, the outer conductor of which is electrically connected to the ground conductor at a terminal, whereas the inner conductor of the coaxial cable is electrically connected to the radiation face located at the top.

Multilayer antennas of planar construction have, for example, become known in the form of what are known as stacked patch antennas. This type of antenna allows the bandwidth of such an antenna to be increased or resonances to be ensured in two or more frequency ranges. Antennas of this type may also be used to improve the antenna gain.

The prior publication IEEE TRANSACTIONS ON ANTENNAS AND PROPAGATION, VOL. AP-27, NO. 2, MARCH 1979, pages 270 to 273, describes a multilayer patch antenna allowing resonance in two frequency ranges. The patch antenna accordingly has, for example, in addition to the bottom ground face and the radiation face arranged offset with respect thereto and stimulated via a supply line, a patch face arranged above, and laterally offset with respect to, the radiation face. The carrier material between the ground face and the radiation face and also between the radiation face and the patch face located thereabove consists, in each case, of a substrate having a uniform dielectric constant.

A patch antenna comprising carrier layers having different dielectric constants has become known, for example, from the prior publication IEEE TRANSACTIONS ON ANTENNAS AND PROPAGATION, VOL. 47, No. 12, DECEMBER 1999, pages 1780 to 1784. Foam is used as the upper carrier layer for the upper metallic face (patch face). The distance between the upper patch face and the radiation face located therebelow corresponds to the distance between the radiation face and the lower ground face.

The prior publication IEEE TRANSACTIONS ON ANTENNAS AND PROPAGATION, VOL. 47, No. 12, DECEMBER 1999, pages 1767 to 1771, among other documents, demonstrates that antenna gain may be increased using multilayer patch antennas.

Finally, a generic antenna having a multilayer construction has become known, for example, from U.S. Pat. No. 5,880,694 A. The antenna comprises a lower ground face, a dielectric carrying member located thereon and having a radiator face located on its upper side. Above the radiator face there is arranged a further dielectric member on which there is provided, on the side remote from the lower ground face, an electrically conductive patch face.

A drawback of all previously known antenna arrangements of this type is the comparatively complex construction. For, in the use of conventional commercial patch antennas having a ground face, an electric carrying member (substrate) located thereon and a radiation face located thereabove, it is invariably complex to supplement an antenna of this type to form a multilayer antenna. Depending on the use of conventional commercial patch antennas, which comprise at least a lower ground face, a substrate made from a dielectric material, for example ceramics, and a radiation face located thereon, a dielectric carrier layer, possibly of variable thickness, would then have to be produced in each case and, for example, positioned and secured on the radiation face of the conventional commercial patch antenna in order then to arrange the electrically conductive patch face on the upper side of this additional dielectric carrying layer. A different, but also highly complex, construction would involve, for example, equipping an antenna housing, below which a conventional commercial patch antenna is integrated, with an additional electrically conductive patch face; however, this would also require complex additional constructional measures.

The exemplary illustrative non-limiting implementation provides an improved multilayer antenna of planar construction, in particular a patch antenna, which, to achieve the electrical characteristics known per se, is provided with a patch radiator provided above the radiation face and which is also of simpler overall construction and/or has improved electrical characteristics.

The solution according to exemplary illustrative non-limiting implementations allows numerous advantages to be achieved.

A basic non-limiting advantage (and one that is highly surprising) is that the exemplary illustrative non-limiting antenna has significantly improved antenna characteristics compared to simple, normal patch antennas. This is all the more surprising in view of the fact that the radiation structure provided at the very top of the patch antenna is arranged at an extremely small distance above the radiation face of the patch antenna and may therefore, in an exemplary illustrative non-limiting implementation, even have longitudinal and transverse extensions which are greater than the radiation face located therebelow. After all, in such a case, the uppermost patch face would be expected adversely to influence the radiation pattern.

A further basic advantage of the exemplary illustrative non-limiting antenna is that conventional commercial patch antennas having a ground face and a radiation face and a dielectric located therebetween—preferably, for example, what are known as ceramic patch antennas—may be easily used without having to be constructionally altered. All that is required is to fasten the three-dimensional electrically conductive structure of the uppermost patch face to a conventional commercial patch antenna using a suitable adhesion and/or fastening layer.

In other words, an additional carrier structure or hood is not required in order to hold this patch face.

In an exemplary illustrative non-limiting implementation, an adhesion layer, in the form of a double-sided adhesive tape or in the form of a comparable adhesion means, is used as an adhesion structure between a conventional commercial patch antenna and the uppermost conductive three-dimensional patch element, allowing simple fastening of the uppermost patch element to a conventional patch antenna.

In an exemplary illustrative non-limiting implementation, the distance between the three-dimensional patch element and the radiation face of a patch antenna is greater than 0.5 mm, in particular greater than 1 mm, for example about 1.5 mm. Although the distance may be even greater, such a small distance between the three-dimensional patch element and the radiation face of a multilayer patch antenna is, in principle, entirely sufficient.

The three-dimensional structure of the patch element may, for example, be provided by what is known as a volume member which, in addition to its two-dimensional extension (comparable, for example, to conventional metal plates or metal layers), also has a significantly greater height or thickness of one or more millimeters.

However, alternatively, it is also possible, for example, for a three-dimensional patch element of this type, arranged above the radiation face, to be equipped with a wholly or partially peripheral edge or web edge, providing effectively a three-dimensional structure. This opens up the possibility for the patch element provided with a three-dimensional structure to be formed by a metal sheet or punched part in which edge portions, which revolve from a two-dimensional element and are oriented transversely and preferably perpendicularly to the plane of the patch element, are upwardly positioned. In the corners, the individual flange or edge portions do not necessarily have to be electrically or electrogalvanically connected to one another. The given electrical connection of a positioned edge element to an adjacent edge element is provided via the central portion, oriented substantially parallel to the radiation and ground face located therebelow, of the patch element.

The aforementioned three-dimensional structure (which is referred to as a "three-dimensional" structure because it has a significantly greater material thickness or material height than metal plates or metal foils used according to the prior art) does not necessarily require the entire member to be configured as what is known as a volume member or the aforementioned peripheral edge necessarily to encircle the entire edge portion of the patch structure. Edge or web elements provided only in certain sections are also sufficient. Recesses or even, for example, a concave deformation of the patch face facing the radiation face located therebelow may also be provided in the patch face itself. However, recesses, which protrude, for example, from the peripheral edge into the patch face, may also be formed in the patch face.

Also possible is the use, for example, of a dielectric member which is made from plastics material and is coated with an electrically conductive layer. On use of a "volume member" of this type having a thickness or height of, for example, more than preferably 0.5 mm or 1 mm, in particular more than 1.5 mm, said member should be provided, at least on a side located parallel to the radiation face, preferably on the side located adjacent to the radiation face and on its peripheral wall or edge portions, with an electrically conductive layer. The upper side, remote from the radiation face of the patch antenna, of the electrically non-conductive member may also, if required, be equipped with an electrically conductive layer.

BRIEF DESCRIPTION OF THE DRAWINGS

These and other features and advantages will be better and more completely understood by referring to the following detailed description of exemplary non-limiting illustrative implementations in conjunction with the drawings of which.

DETAILED DESCRIPTION

Figure 1:
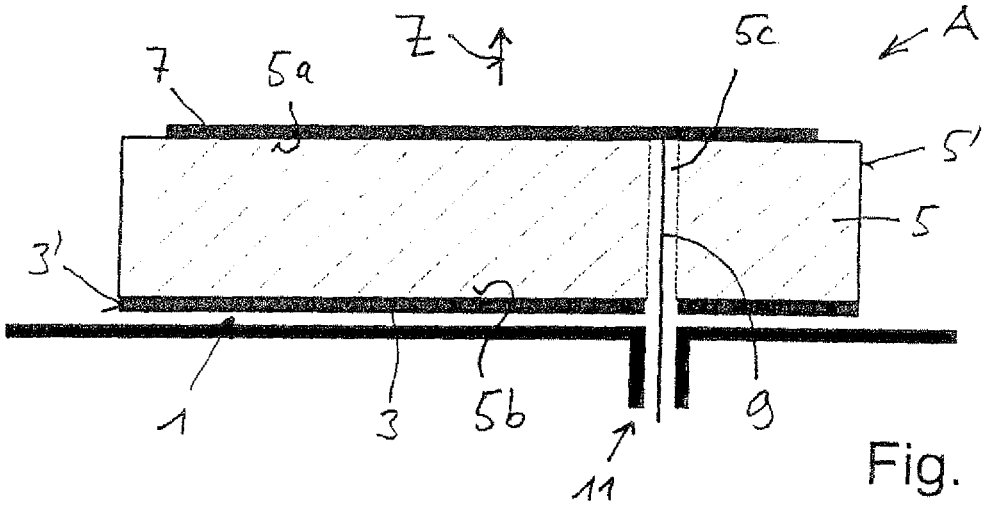
FIG. 1 is a schematic axial sectional view through a conventional commercial patch antenna according to the prior art.
Figure 2:
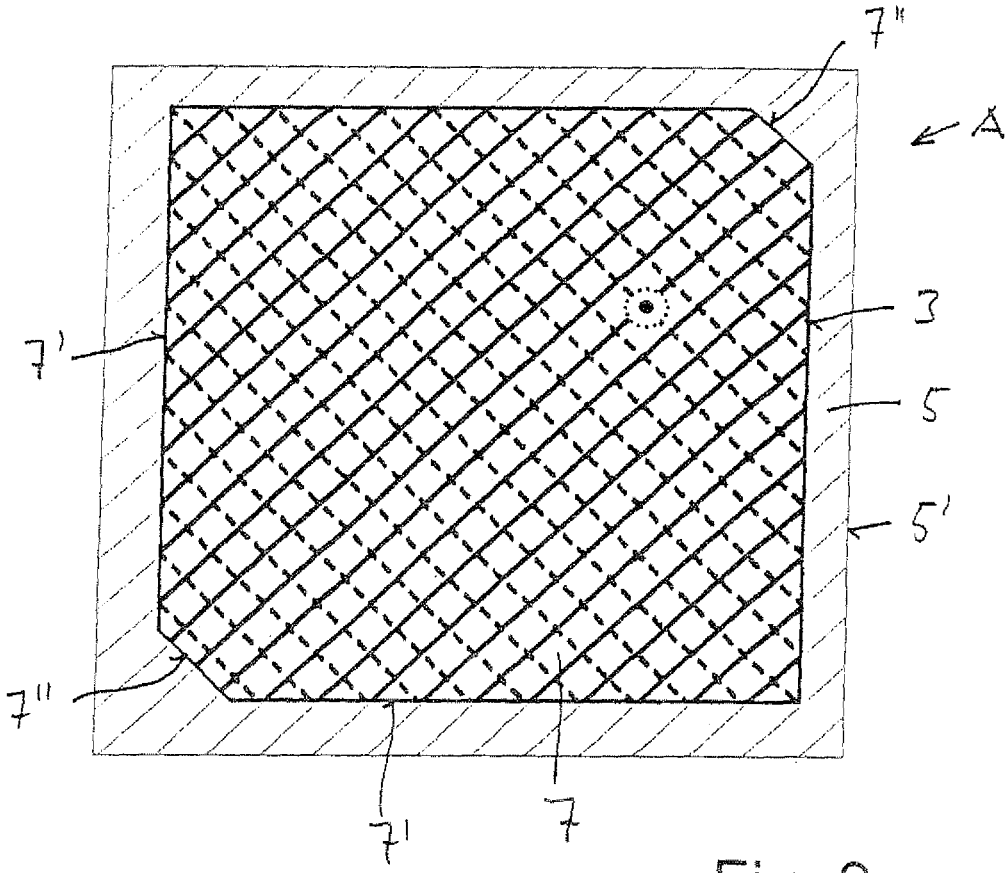
FIG. 2 is a schematic plan view of the patch antenna according to FIG. 1 known from the prior art.
Figure 3:
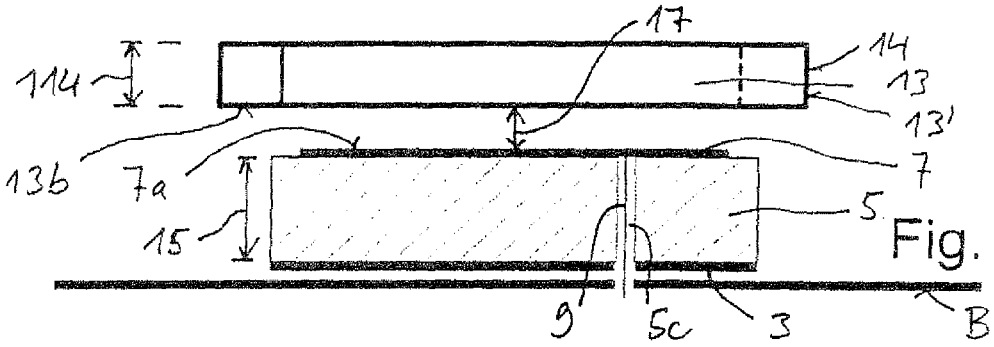
FIG. 3 is a schematic transverse or side view of an exemplary illustrative non-limiting stacked patch antenna.

FIG. 1 is a schematic side view and FIG. 2 a schematic plan view of the basic construction of a conventional commercial patch radiator A (patch antenna) which in FIG. 3 and following is extended to form a multilayer patch antenna (stacked patch antenna).

The patch antenna shown in FIGS. 1 and 2 comprises a plurality of faces and layers which are arranged one above the other along an axial axis Z and will be considered hereinafter.

It is apparent from the schematic sectional view according to FIG. 1 that the patch antenna A has on what is known as its lower or attachment side 1 an electrically conductive ground face 3. Arranged on the ground face 3, or laterally offset with respect thereto, is a dielectric carrier 5 which, in plan view, conventionally has an outer contour 5' corresponding to the outer contour 3' of the ground face 3. However, this dielectric carrier 5 may also be larger or smaller in its configuration and/or be provided with an outer contour 5' differing from the outer contour 3' of the ground face 3. In general, the outer contour 3' of the ground face may be n-polygonal and/or even be provided with sinuous portions or be sinuous in its configuration, although this is unconventional.

This dielectric carrier 5 has a sufficient height or thickness, which generally corresponds to a multiple of the thickness of the ground face 3; i.e., in contrast to the ground face 3, which basically consists merely of a two-dimensional face, this dielectric carrier 5 is configured as a three-dimensional member having sufficient height and thickness.

On the upper side 5*a* opposing the lower side 5*b* (which becomes adjacent to the ground face 3) there is configured an electrically conductive radiation face 7 which may, again, also basically be understood as a two-dimensional face. This radiation face 7 is supplied with electricity and stimulated via a supply line 9 which preferably extends in the transverse direction, in particular perpendicularly to the radiation face 7, from below, through the dielectric carrier 5 in a corresponding bore or a corresponding channel 5*c*.

From a connection point 11, which is generally located at the bottom and to which a coaxial cable (not shown in greater detail) may be connected, the inner conductor of the coaxial cable (not shown) is electrogalvanically connected to the supply line 9, and is therefore connected to the radiation face 7. The outer conductor of the coaxial cable (not shown) is then electrogalvanically connected to the ground face 3 located at the bottom.

FIG. 2 shows an exemplary illustrative non-limiting patch antenna having a dielectric 5 and a square shape in plan view. This shape or the corresponding contour or outline 5' may, however, also be non-square and, in general, be an n-polygonal shape. Sinuous outer boundaries may even be provided, although this is unconventional.

The radiation face 7 resting on the dielectric 5 may have the same contour or outline 7' as the dielectric 5 located therebelow. In the illustrated non-limiting implementation, the basic shape is also square in its formation (in adaptation to the outline 5' of the dielectric 5) but has, at two opposing ends, flat portions 7" which are formed practically by the omission of an isosceles-rectangular triangle. In general, the outline 7' may therefore also be an n-polygonal outline or contour or even be provided with a sinuous outer boundary 7'.

The aforementioned ground face 3 and also the radiation face 7 are described in certain respects as being "two-dimensional" faces, since their thickness is so low that they can hardly be described as being "volume members". The thickness of the ground face and the radiation face 3, 7 is conventionally below 1 mm, i.e. generally below 0.5 mm, in particular below 0.25 mm, 0.20 mm, 0.10 mm.

Figure 4:
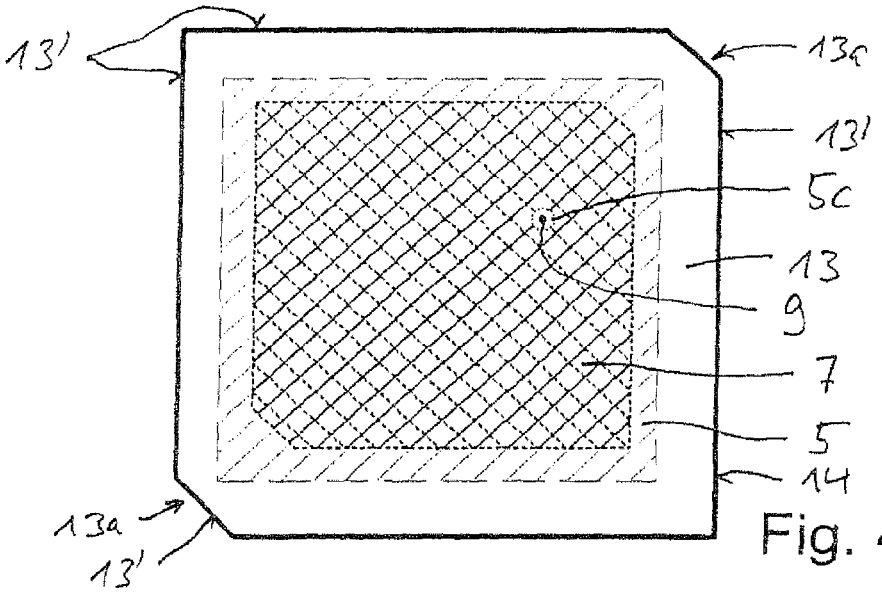
FIG. 4 is a schematic plan view of the exemplary illustrative non-limiting implementation according to FIG. 3.

Above the patch antenna A thus formed, which may, for example, consist of a conventional commercial patch antenna A, preferably of what is known as a ceramic patch antenna (in which, that is, the dielectric carrier layer 5 is made from a ceramic material), there is then additionally arranged, in the case of an exemplary illustrative non-limiting stacked patch antenna according to FIGS. 3 and 4, laterally offset or offset in terms of height with respect to the upper radiation face 7, a patch element 13 (FIG. 3) which, compared to the aforementioned ground face 3 and the radiation face 7, has a three-dimensional structure having a significantly different, i.e. greater, height or thickness.

The stacked patch antenna thus described is, for example, positioned on a chassis B (illustrated in FIG. 3 merely as a line) which may, for example, be the base chassis for a motor vehicle antenna, in which the exemplary illustrative non-limiting antenna, optionally in addition to further antennas for other services, may be integrated. For example, the exemplary non-limiting stacked patch antenna may, in particular, be used as an antenna for geostationary positioning and/or for the reception of satellite or terrestrial signals, for example from what is known as the SDAR service. However, this does not entail any limitation to use for other services as well.

The patch element 13 may, for example, consist of an electrically conductive metallic member, i.e., for example, a cuboid having appropriate longitudinal and transverse extensions and sufficient height and thickness.

As is apparent from the plan view according to FIG. 4, this patch element 13 may, however, also have an outline 13' differing from a rectangular or square structure. That is to say, as is known, the patch antenna may be further adapted in certain respects by the working-off of edge regions, for example of corner regions 13*a* apparent in FIG. 4.

In the illustrated non-limiting implementation, the patch element 13 has a longitudinal extension and a transverse extension which, on the one hand, are greater than the longitudinal and transverse extensions of the radiation face 7 and/or, on the other hand, are also greater than the longitudinal and transverse extensions of the dielectric carrier 5 and/or of the ground face 3 located therebelow.

Figure 5:
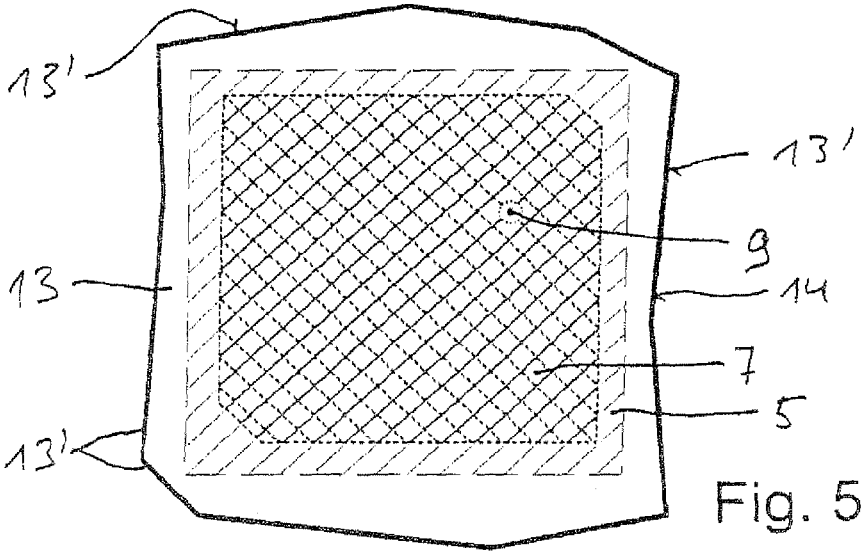
FIG. 5 is a plan view, corresponding to FIG. 4, of an exemplary illustrative non-limiting patch antenna, with a different implementation of the patch element located at the top.

In very general terms, the patch element 13 may also have, entirely or in part, convex or concave and/or other sinuous outlines or an n-polygonal outline, or mixed forms of both, as is shown in plan view, purely schematically, for a differing non-limiting implementation according to FIG. 5, the patch element 13 in this case having a non-uniform outer contour or a non-uniform outline 13'.

The patch element 13 has a thickness which is not only double, three, four or five times, etc., but rather above all ten times, 20, 30, 40, 50, 60, 70, 80, 90 and/or 100 and more times the thickness of the ground face 3 and/or the thickness of the radiation face 7.

In the illustrated non-limiting implementation, the thickness or height 14 of the patch element 13 is equal to or greater than a spacing 17 formed by the lower side 13*b* of the patch element 13 and the upper side 7*a* of the radiation face 7.

On the other hand, this spacing 17 should also not be less than 0.5 mm, preferably greater than 0.6 mm, 0.7 mm, 0.8 mm, 0.9 mm, or equal to or greater than 1 mm. Values about 1.5 mm, i.e. generally between 1 mm and 2 mm or 1 mm and 3 mm, 4 mm or 5 mm are entirely sufficient.

On the other hand, it should also be noted that the height or thickness 14 of the three-dimensional patch element 13 is preferably less than the height or thickness 15 of the dielectric carrier 5. The uppermost patch element 13 preferably has a thickness or height 14 corresponding to less than 90%, in particular less than 80%, 70%, 60%, 50% or even less than 40% and optionally 30% or less than 20% of the height or thickness 15 of the carrier element 5.

On the other hand, the abovementioned height does not necessarily have to be prerestricted. The height or thickness 14 of the three-dimensional patch element 13 may also therefore be greater, and above all significantly greater, than the thickness of the dielectric carrier 5. In other words, the carrier element 5 may, for example, have a height or thickness 15 corresponding to up to 1.5 times, twice, four, five, six, seven, eight, nine and/or ten and more times the height or thickness 15 of the carrier element 5.

On the other hand, the thickness or height 14 of the patch element 13 should preferably be greater than the distance 17 between the radiation face 7 and the lower side 13*b* of the patch element 13.

A carrying means 19, in particular a dielectric carrying means 19, via which the patch element 13 is held and carried, is preferably used. This dielectric carrying means 19 preferably consists of an adhesion or mounting layer 19' (FIG. 6) which may, for example, be configured as what is known as a double-sided adhesive adhesion and mounting layer 19'. Conventional commercial double-sided adhesive tapes or double-sided adhesive foam tapes, adhesive pads or the like, which have an appropriate, abovementioned thickness, may be used for this purpose. This opens up the simple possibility of fastening and mounting in this way the aforementioned patch element 13 on the upper side of a conventional commercial patch antenna, in particular a conventional commercial ceramic patch antenna.

However, instead of the electrically fully conductive metallic member as the patch element 13, a plastics material member, which is provided, for example, with an electrically conductive lower side 13*b* and electrically conductive peripheral lateral boundaries 13*c*, may, for example, also be used, for example by applying an electrically conductive outer layer. The upper side 13*d* does not necessarily have to be electrically conductive, although the entire surface of the patch element 13 thus formed, which is per se non-conductive, may be provided with a peripheral electrically conductive layer.

Figure 7:
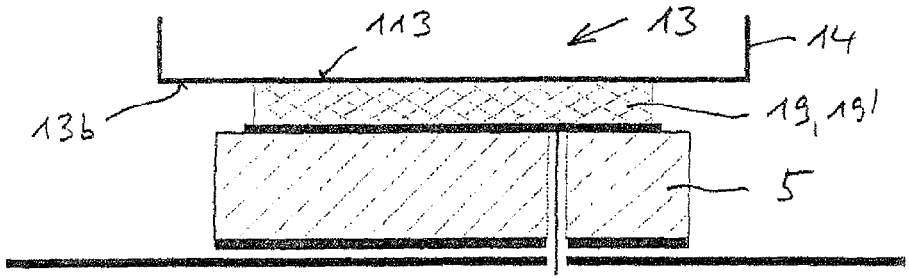
FIG. 7 is a schematic side and/or sectional view of an exemplary illustrative non-limiting implementation differing from FIG. 6.

FIG. 7 shows a modification in which the three-dimensional patch element 13 is configured not as a volume member but rather as a plate-type patch element 13 provided with a peripheral lateral or edge web 14.

Figure 8:
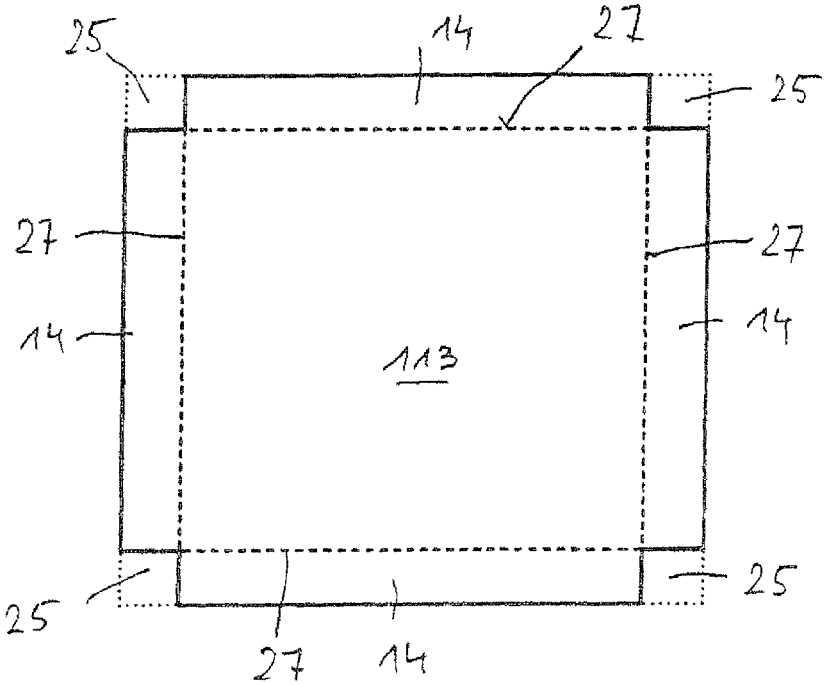
FIG. 8 is a schematic plan view of an exemplary illustrative non-limiting patch element as used on development of the non-limiting implementation according to FIG. 7.

A patch element 13 of this type may, for example, be made from a metal sheet by punching and edging as illustrated, for example, in plan view in FIG. 8.

FIG. 8 shows the outlines of a metal part, for example having an approximately square shape, corners 25 having been punched out in the corner regions. The edge regions or webs 14 thus formed may then be positioned along the edge lines 27, opposing the base 113 of the patch element 13, so these edge regions or webs 14 extend transversely to the base 113 of the patch element 13 and preferably perpendicularly thereto. The lines of intersection thus formed between two edge webs 14, located adjacent to one another in the circumferential direction and extending perpendicularly to one another in the exemplary illustrative non-limiting implementation, do not have to be electrogalvanically interconnected, for example by soldering, at their lines of intersection and/or contact. The electrical connection via the two-dimensional central portion 113 of the patch element 13 is sufficient.

In this case, too, the lower side 13*b* of the patch element 13 thus formed is fastened to the upper side of a, for example conventional commercial, patch antenna A using a carrying means, for example using a layered dielectric carrying means 19, preferably in the form of an adhesion or mounting carrier 19', wherein a conventional commercial patch antenna A may also, but does not have to, be coated with a dielectric layer on the upper side of its radiation face 7.

Figure 9A:
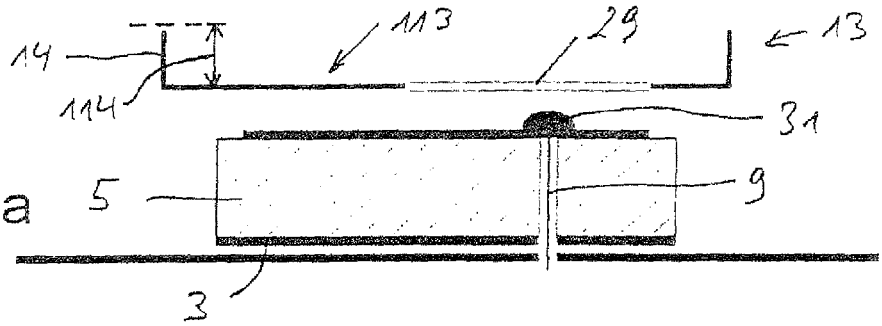
FIG. 9*a* shows a further exemplary illustrative non-limiting implementation.
Figure 9B:
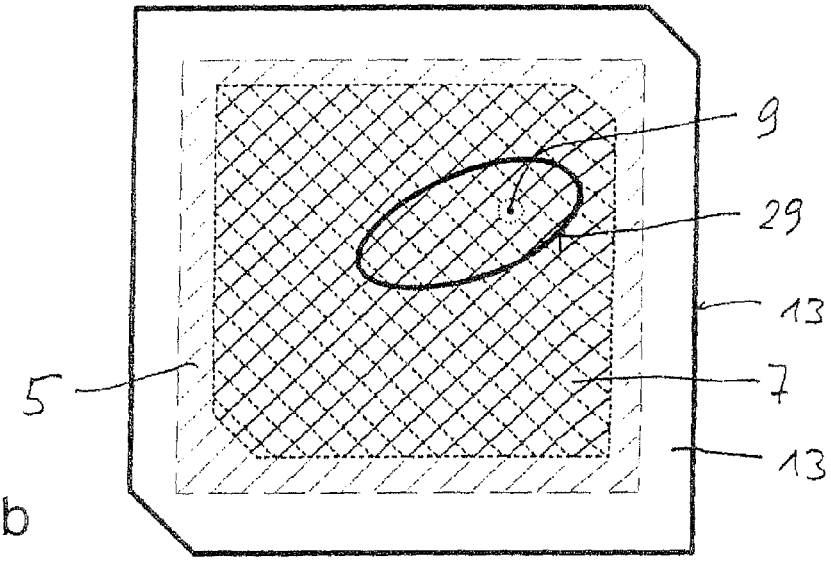
FIG. 9*b* is a plan view of the exemplary illustrative non-limiting implementation according to FIG. 9*a;*

FIG. 9*a* shows in schematic cross section and FIG. 9*b* in schematic plan view that the patch element 13 described, by way of example, with reference to FIGS. 7 and 8 may be provided in its two-dimensional lower side 13*b* with a recess or a hole 29. This recess or this hole 29 is preferably provided in the region in which the supply line 9 is connected to the radiation face 7, generally by soldering. For, a soldered elevation 31 protruding beyond the surface of the radiation face 7 is conventionally configured at this point. Even if only a very thin carrying means 19, preferably in the form of an adhesion or mounting carrier 19', is used, this ensures that, firstly, a good mechanical adhesive connection may be produced between the patch element 13, via the carrying means 19, preferably in the form of the adhesion or mounting layer 19', and the, generally conventional commercial, patch antenna located therebelow and, secondly, electrical contacting between the soldered elevation 31 and the patch element 13 may be reliably prevented. For the sake of clarity, the carrying means 19, preferably in the form of an adhesion and/or mounting layer 19', has not been illustrated in FIG. 9*a* (and also in FIGS. 10 and 11, discussed hereinafter). For the sake of clarity, in FIG. 9*b*, the upper patch 13 is shown to be almost "transparent", so the aforementioned recess or the hole 29 is denoted merely by a corresponding outline.

Figure 10:
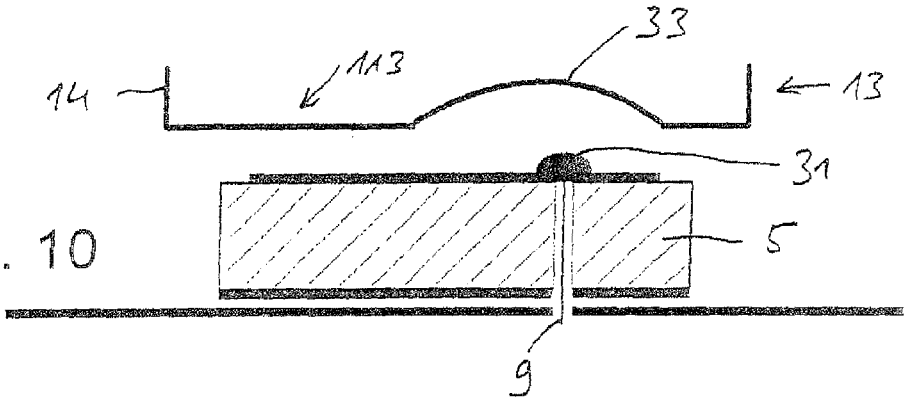
FIG. 10 shows an exemplary illustrative non-limiting implementation further differing from FIGS. 7, 9*a* and 9*b;*

Similar advantages may also be achieved according to a configuration corresponding to FIG. 10. In FIG. 10, a deformation 33, which protrudes in an upwardly convex manner and preferably comes to rest above the electrically conductive connection between the supply line 9 and the supply face 7, i.e. generally where a soldered elevation 31 is formed, is integrated in the electrically conductive lower plane 13*b* of the patch element 13.

Figure 11:
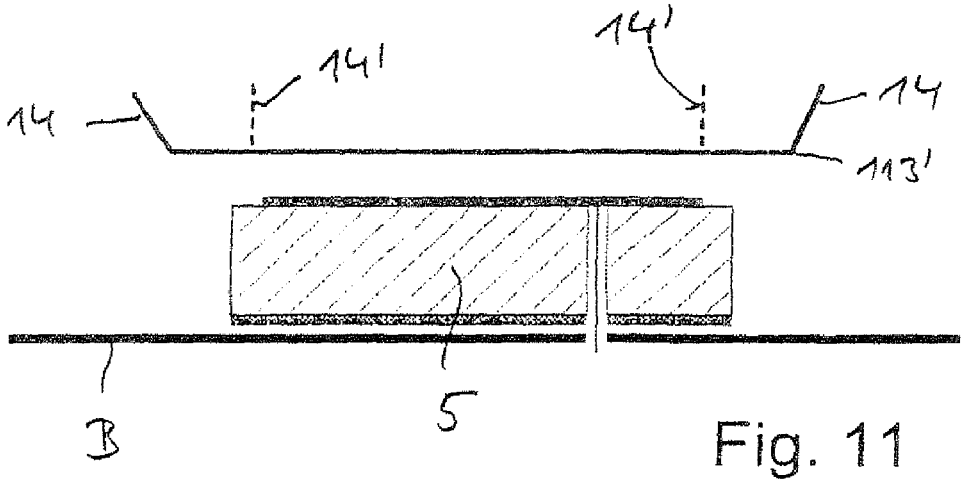
FIG. 11 shows an exemplary illustrative non-limiting implementation further differing from FIGS. 7, 9*a*, 9*b* and 10.

Finally, FIG. 11 merely shows that the aforementioned edge portions 14, which, in the exemplary illustrative non-limiting implementations, are each provided at the peripheral outer edge 113' of the patch face of the patch element 13, do not have to be oriented perpendicularly to the base 113 of the patch element 13 but may also, for example, as illustrated in FIG. 11, be provided at an angular orientation differing from the perpendicular. In the exemplary illustrative non-limiting implementation according to FIG. 11, the edge lateral boundaries 14 diverge along the axial attachment direction A (in FIG. 1), i.e. are oriented extending away from one another, from the base or central face 113 in the direction of radiation. However, the edge lateral portions may equally be oriented facing one another. Equally, on one side, the lateral boundaries 14 may, for example, be curved in the other direction A, more toward the central portion 113 of the patch 13, and, on the other side, be oriented extending away from the central face 113. Finally, these webs or edge portions 14 do not necessarily have to be provided on the outermost outline edge 113' but may rather be located further inwardly offset, as indicated, by way of example, by broken lines in FIG. 11 for webs extending transversely to the base 113 or other types of elevations 14' which are arranged on the patch element so as to be further inwardly offset with respect to the outer boundary 113'. However, these webs or elevations 14' shown in FIG. 11 may also be oriented extending non-perpendicularly, inclined more outwardly or more inwardly. Furthermore, they also do not have to be web or band-shaped in cross section but may rather have a voluminous triangular cross section or any other sectional shapes.

Figure 6:
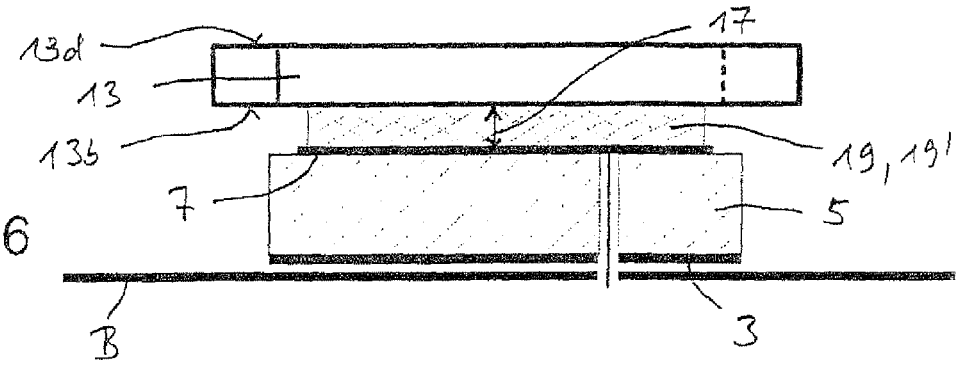
FIG. 6 is a side or sectional view, corresponding to FIG. 3, of the exemplary illustrative non-limiting patch antenna, reproducing a carrying means used for the upper patch element.

Finally, it should also be noted that on use of a volume member, too—comparable, for example, to the exemplary illustrative non-limiting implementation according to FIG. 3 or 6—the peripheral boundary faces 13' (lateral boundaries 13*c*) do not have to be oriented perpendicularly to the lower or upper side 13*b*, 13*d* of the patch element 13 but may rather also be configured with lateral faces extending obliquely—comparable to the inclined extending edges or webs 14 in FIG. 11.

The exemplary illustrative non-limiting stacked patch antenna may preferably be used as an antenna within the context of a motor vehicle antenna, in addition to further antennas for other services. However, this does not entail any limitation to such uses. The conventional commercial patch antenna A used within the context of this exemplary stacked patch antenna preferably consists—as stated—of a dielectric carrier 5, the upper or lower side of which consists of a metallic or electrically conductive layer 7 or 3 and is fixed to the carrier 5.

Figure 12:
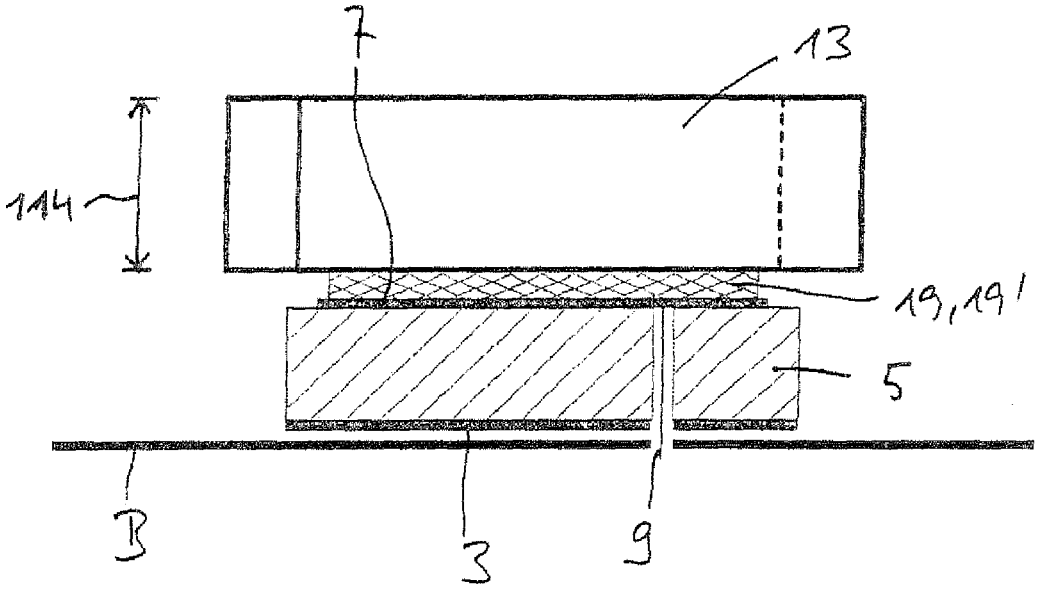
FIG. 12 shows a further modified exemplary illustrative non-limiting implementation in which the height or thickness of the patch element is significantly greater.

Finally, reference is also made to FIG. 12, which illustrates a further exemplary illustrative non-limiting implementation. This non-limiting implementation uses an upper patch element 13 which—as is apparent from the Figure—has a thickness or height 14 which is even greater than the thickness or height of the dielectric carrier 5. Despite this comparatively great height or the relatively great extension parallel to the substrate face, the patch antenna thus formed also has improved electrical characteristics.

While the technology herein has been described in connection with exemplary illustrative non-limiting implementations, the invention is not to be limited by the disclosure. The invention is intended to be defined by the claims and to cover all corresponding and equivalent arrangements whether or not specifically disclosed herein.

The invention claimed is:

1. A multilayer patch antenna of planar construction having a plurality of faces and/or layers arranged along an axial axis, the patch antenna comprising:

an electrically conductive ground face, a conductive radiation face which is arranged at a distance above the ground face and extends substantially parallel thereto, a dielectric carrier arranged between the ground face and the radiation face, the radiation face being electrically connected to an electrically conductive supply line, a carrying means provided on the side of the radiation face that opposes the ground face, and an electrically conductive patch element provided on the side of the carrying means that opposes the radiation face and is displaced from the radiation face, the carrying means having a thickness occupying the entire spacing between the radiation face and the electrically conductive patch element when viewed in cross-section, the carrying means thickness being less than the thickness or height of the patch element, wherein the thickness or height of the patch element is more than double the thickness of the ground face and/or the thickness of the radiation face.

2. The antenna as claimed in claim 1, wherein the thickness or height of the patch element is less than the thickness or height of the dielectric carrier between the outer face and the radiation face.

3. The antenna as claimed in claim 1, wherein the at least one of the thickness and the height of the patch element is a multiple of the corresponding thickness or height of the dielectric carrier.

4. The antenna as claimed in claim 1, wherein the patch element has at least substantially a longitudinal and/or transverse extension of the radiation face which is greater than or equal to the longitudinal and/or transverse extension of the dielectric carrier and/or is greater than the longitudinal or transverse extension of the ground face, wherein the patch element has an extent that is greater than the dielectric carrier, the dielectric face, the carrying means and the dielectric ground face.

5. The antenna as claimed in claim 1, wherein the thickness or height of the carrying means is greater than 0.5 mm.

6. The antenna as claimed in claim 5, wherein the thickness or height of the carrying means is less than 5 mm.

7. The antenna as claimed in claim 1, wherein the carrying means comprises an adhesion or mounting layer.

8. The antenna as claimed in claim 6, wherein the carrying means comprises a dielectric carrying layer including a double-sided adhesive adhesion or mounting means.

9. The antenna as claimed in claim 1, wherein the patch element comprises a three-dimensional volume member.

10. The antenna as claimed in claim 1, wherein the patch element comprises a metal sheet-type, foil-type or layer-type central or base portion, elevations, edges and/or webs being configured on the base or central portion, projecting transversely to the face thereof.

11. The antenna as claimed in claim 10, wherein the elevations, edges and/or webs are configured on the peripheral edge of the base or central portion of the patch element and project transversely to the base portion face.

12. The antenna as claimed in claim 10, wherein the elevations, edges and/or webs are provided further inwardly offset at the outer edge of the central or base portion of the patch element.

13. The antenna as claimed in claim 10, wherein the patch element consists of a metal sheet, the webs or edges of which are formed by cutting or punching and subsequent edging.

14. The antenna as claimed in claim 1, wherein the patch element is made from an electrically conductive material, in particular metal.

15. The antenna of claim 1 wherein said antenna is single-banded and said patch element is unfed.

16. A multilayer patch antenna of planar construction having a plurality of faces and/or layers arranged along an axial axis comprising:

an electrically conductive ground face, a conductive radiation face which is arranged with lateral spacing from the ground face and extending substantially parallel thereto, a dielectric carrier arranged between the ground face and the radiation face, the radiation face being electrically connected to an electrically conductive supply line, a carrying means provided on the side of the radiation face that opposes the ground face, and an electrically conductive patch element provided on the side of the carrying means that opposes the radiation face, the carrying means having a thickness occupying the entire spacing between the radiation face and the electrically conductive patch element when viewed in cross-section, the carrying means thickness being less than the thickness or height of the patch element, wherein the patch element comprises a metal sheet-type, foil-type or layer-type base or central portion, elevations, edges and/or webs being configured on the base or central portion, projecting transversely to the face thereof, and wherein the edges or webs are oriented perpendicularly to the face of the central or base portion of the patch element.

17. The antenna of claim 15 wherein said antenna is single-banded and said patch element is unfed.

18. A multilayer patch antenna of planar construction having a plurality of faces and/or layers arranged along an axial axis comprising:

an electrically conductive ground face, a conductive radiation face which is arranged with lateral spacing from the ground face and extending substantially parallel thereto, a dielectric carrier arranged between the ground face and the radiation face, the radiation face being electrically connected to an electrically conductive supply line, a carrying means provided on the side of the radiation face that opposes the ground face, and an electrically conductive patch element provided on the side of the carrying means that opposes the radiation face, the carrying means having a thickness occupying the entire spacing between the radiation face and the electrically conductive patch element when viewed in cross-section, the carrying means thickness being less than the thickness or height of the patch element, wherein the patch element comprises a metal sheet-type, foil-type or layer-type central or base portion, elevations, edges and/or webs being configured on the base or central portion, projecting transversely to the face thereof, and wherein the edges or webs are oriented at an angle, diverging from the perpendicular, to the face of the central or base portion of the patch element.

19. A multilayer patch antenna of planar construction having a plurality of faces and/or layers arranged along an axial axis comprising:

an electrically conductive ground face, a conductive radiation face which is arranged with lateral spacing from the ground face and extending substantially parallel thereto, a dielectric carrier arranged between the ground face and the radiation face, the radiation face being electrically connected to an electrically conductive supply line, a carrying means provided on the side of the radiation face that opposes the ground face, and an electrically conductive patch element provided on the side of the carrying means that opposes the radiation face, the carrying means having a thickness occupying the entire spacing between the radiation face and the electrically conductive patch element when viewed in cross-section, the carrying means thickness being less than the thickness or height of the patch element, wherein the patch element comprises a lower plane, and there is provided in the patch element a recess or a hole or an indentation which extends above the lower plane of the patch element, away from the radiation face located therebelow.

20. The antenna as claimed in claim 19, wherein the hole or the recess or the indentation is provided in the region in which, in plan view, the supply line is contacted with the radiation face.

21. The antenna of claim 19 wherein said antenna is single-banded and said patch element is unfed.

22. A multilayer patch antenna of planar construction having a plurality of faces and/or layers arranged along an axial axis comprising:

an electrically conductive ground face, a conductive radiation face which is arranged with lateral spacing from the ground face and extending substantially parallel thereto, a dielectric carrier arranged between the ground face and the radiation face, the radiation face being electrically connected to an electrically conductive supply line, a carrying means provided on the side of the radiation face that opposes the ground face, and an electrically conductive patch element provided on the side of the carrying means that opposes the radiation face, the carrying means having a thickness occupying the entire spacing between the radiation face and the electrically conductive patch element when viewed in cross-section, the carrying means thickness being less than the thickness or height of the patch element, wherein the patch element is made from an electrically non-conductive material and is entirely or partially coated with an electrically conductive layer, at least the central or base portion and the peripheral lateral boundaries or the provided edges or webs being provided with an electrically conductive layer.

23. The antenna of claim 22 wherein said antenna is single-banded and said patch element is unfed.

* * * * *